US011331909B2

(12) United States Patent
Anderson et al.

(10) Patent No.: US 11,331,909 B2
(45) Date of Patent: May 17, 2022

(54) THERMAL ZONE SELECTION WITH A CIRCULAR SHIFT REGISTER

(71) Applicant: Hewlett-Packard Development Company, L.P., Spring, TX (US)

(72) Inventors: Daryl E. Anderson, Corvallis, OR (US); Eric T. Martin, Corvallis, OR (US); James Michael Gardner, Corvallis, OR (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 17/045,517

(22) PCT Filed: Jun. 11, 2018

(86) PCT No.: PCT/US2018/036926

§ 371 (c)(1),
(2) Date: Oct. 6, 2020

(87) PCT Pub. No.: WO2019/240760

PCT Pub. Date: Dec. 19, 2019

(65) Prior Publication Data

US 2021/0362491 A1 Nov. 25, 2021

(51) Int. Cl.
*B41J 2/045* (2006.01)

(52) U.S. Cl.
CPC ..... *B41J 2/04563* (2013.01); *B41J 2/04541* (2013.01); *B41J 2/04543* (2013.01); *B41J 2/04573* (2013.01); *B41J 2/04598* (2013.01)

(58) Field of Classification Search
CPC ..... B41J 2/04563
See application file for complete search history.

(56) References Cited

U.S. PATENT DOCUMENTS

| | | | | |
|---|---|---|---|---|
| 5,541,629 | A | 7/1996 | Saunders et al. | |
| 6,634,735 | B1 | 10/2003 | Silverbrook | |
| 7,591,523 | B2 | 9/2009 | Sheahan et al. | |
| 8,011,747 | B2 | 9/2011 | Walmsley et al. | |
| 2002/0067384 | A1 | 6/2002 | Anderson et al. | |
| 2005/0049729 | A1 | 3/2005 | Culbert et al. | |
| 2007/0120884 | A1 | 5/2007 | Lecheheb | |
| 2008/0252674 | A1* | 10/2008 | Ushinohama | B41J 2/04563 347/14 |
| 2009/0040258 | A1* | 2/2009 | Baek | B41J 2/14153 347/17 |

(Continued)

FOREIGN PATENT DOCUMENTS

| | | |
|---|---|---|
| WO | WO-2017019065 | 2/2017 |
| WO | WO-2017135968 | 8/2017 |

*Primary Examiner* — Shelby L Fidler
(74) *Attorney, Agent, or Firm* — Austin Rapp

(57) ABSTRACT

Examples of a fluidic die for thermal zone selection with a circular shift register are described herein. In some examples, the fluidic die includes multiple thermal zones. Each thermal zone includes a temperature sensor and a fluidic actuator. The fluidic die also includes shared thermal control circuitry to process an output of the temperature sensor of a selected thermal zone. The fluidic die further includes a circular shift register that includes multiple memory elements. Each memory element is associated with one thermal zone. A token circulates within the circular shift register to select one thermal zone at a time for processing by the shared thermal control circuitry.

15 Claims, 6 Drawing Sheets

(56) References Cited

U.S. PATENT DOCUMENTS

2010/0315454 A1* 12/2010 Kanno ..... B41J 2/04541
347/10
2012/0306953 A1* 12/2012 Kanno ..... B41J 2/0451
347/11

* cited by examiner

THERMAL ZONE SELECTION WITH A CIRCULAR SHIFT REGISTER

BACKGROUND

Fluid ejection systems may be used to emit a fluid. For example, printing devices provide a user with a physical representation of a document by printing a digital representation of a document onto a print medium. The printing devices may include a number of fluidic dies used to eject ink or other printable material onto the print medium to form an image. In some examples, a fluidic die may deposit fluid droplets onto the print medium using a number of fluidic actuators (e.g., resistive elements) within the fluidic die. In other examples, a fluidic actuator may move a fluid on the fluidic die.

Figure 1:
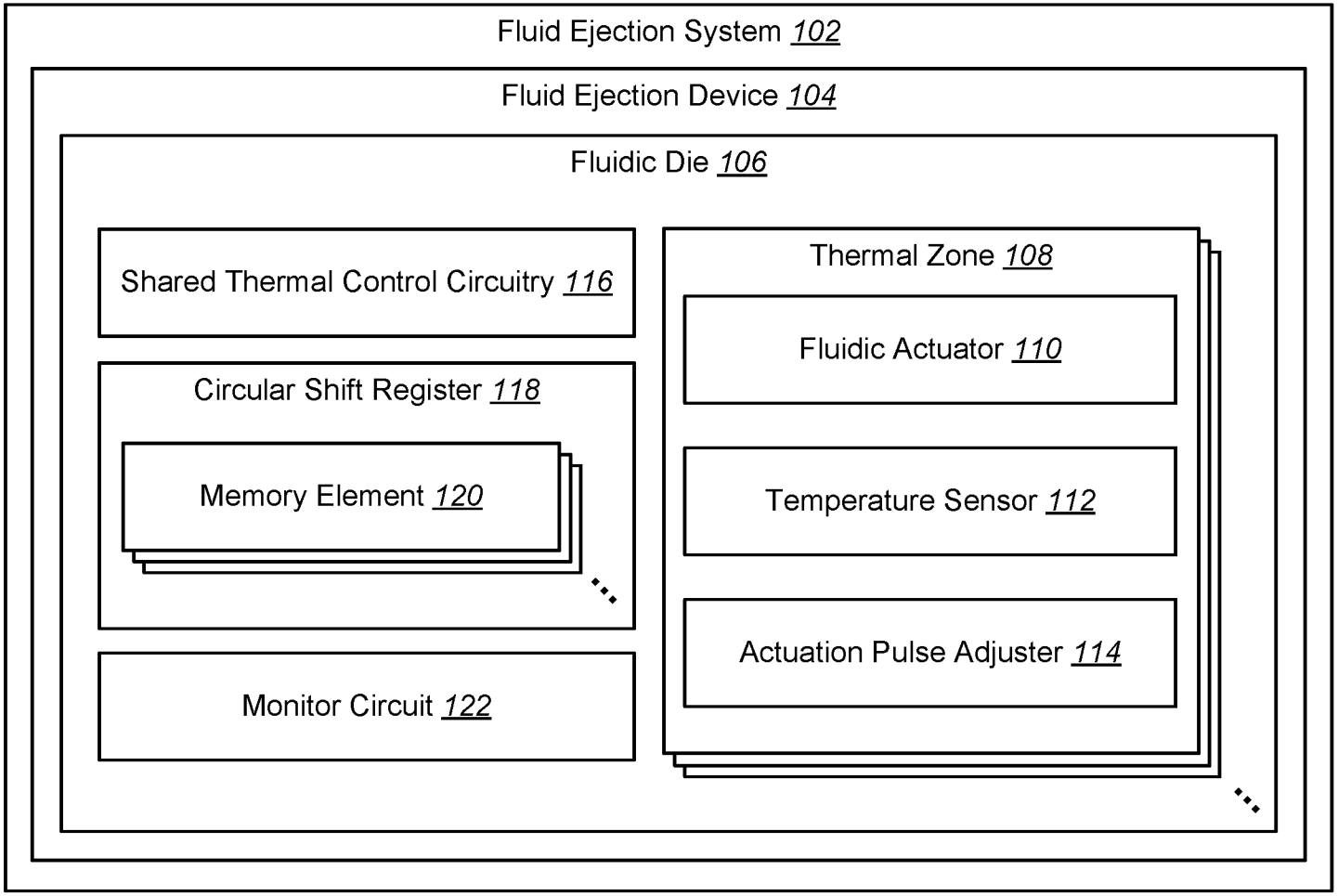
FIG. 1 is a simplified block diagram of a fluid ejection system incorporating a fluidic die for thermal zone selection with a circular shift register according to an example of the principles described herein.

Throughout the drawings, identical reference numbers designate similar, but not necessarily identical, elements. The figures are not necessarily to scale, and the size of some parts may be exaggerated to more clearly illustrate the example shown. Moreover the drawings provide examples and/or implementations consistent with the description; however, the description is not limited to the examples and/or implementations provided in the drawings.

DETAILED DESCRIPTION

The disclosure describes systems, methods and apparatus to provide for continuous sequential selection of thermal zones of a fluidic die to be processed by shared thermal control circuitry. The fluidic die includes multiple thermal zones of at least one fluidic actuator. The fluidic die also includes shared thermal control circuitry for processing the thermal zones. The sequential selection of thermal zones is done by a circular shift register with a single token bit which circulates within, selecting one thermal zone at a time for processing by the shared thermal control circuitry. The token is advanced by a command from the shared thermal control circuitry once processing of the current zone is complete.

In some examples, the fluidic die may include at least one resistive element that generates heat in a thermal zone. The fluidic die may also include other circuits that produce heat in their operational modes. As the fluidic die elements produce heat, it may be desirable to measure and control the temperature of each thermal zone.

Examples described herein relate to selecting a thermal zone for processing by shared thermal control circuitry. In some examples, the temperature of the multiple thermal zones of a fluidic die may be controlled using components and sequences of operations described herein. In such examples, control of thermal zones of a fluidic die may be referred to as switch zone warming. Switch zone warming corresponds to independent management and control of distinct thermal regions on an example fluidic die.

Each thermal zone of the fluidic die may have a temperature sensor. Shared thermal control circuitry in the fluidic die may be coupled to the thermal zones. The shared thermal control circuitry may determine if the temperature of a given thermal zone is less than a target temperature (also referred to as a setpoint temperature or setpoint). In some examples, the target temperature can be applied globally to the entire fluidic die. In other examples, the target temperature may be unique for each thermal zone.

If a thermal zone's temperature is less than the target temperature, then the thermal zone is instructed by the shared thermal control circuitry to allow warming to occur. Subsequent analysis of the temperature by the shared thermal control circuitry will determine whether to actuate heating elements. For example, control circuitry may electrically actuate heating elements in the thermal zone based on the thermal zone temperature. The control circuits may adjust pulses to heating elements based on the thermal zone temperature.

Another benefit of the switch zone warming sensing is that for a fluidic die that includes fluidic actuators, knowing the temperature of different zones can be used to modulate the energy used to actuate the fluidic actuators. For example, if the fluidic die (or fluid) is warmer, a reduced actuation energy may be used.

In some approaches, warming is accomplished by turning a heater on or off. However, in other approaches (e.g., switch zone warming), a precursor pulse (PCP) may occur before the main fire pulse in a thermal zone. The PCP may be adjusted to compensate for the temperature variation without the need to add heat to or remove heat from the fluidic die. For example, in this approach, thermal zones that are warmer may have their PCP trimmed, thereby maintaining the correct drop weight. Alternatively, thermal zones that are cooler may have their PCP lengthened.

Temperature sensors may be spread across a large distance on the fluidic die. For example, temperature sensors may be spread across the fluidic die in physically dispersed thermal zones. Because the temperature of various regions on the fluidic die may vary, a fluidic die controller may determine the temperature gradients through measuring of the multiple temperature sensors on the fluidic die.

A fluidic die may include a shared thermal control circuitry (also referred to as a common thermal control resource) to process the multiple thermal zones. A method to select the thermal zones to be processed is discussed herein. For a fluidic die with multiple thermal zones, addressing of thermal zones, while allowing for arbitrary selection of the thermal zones, is unnecessarily expensive and complicated (e.g., due to the area used on the fluidic die and the complexity of the logic). As described herein, selection of the thermal zones for processing by the shared thermal control circuitry may be accomplished according to a predefined sequence.

In the following description, for purposes of explanation, numerous specific details are set forth in order to provide a thorough understanding of the present systems and methods. As may be appreciated, the present apparatus, systems, and methods may be practiced without these specific details. Reference in the specification to "an example" or similar language means that a particular feature, structure, or characteristic described in connection with that example is included as described, but may not be included in other examples.

FIG. 1 is a simplified block diagram of a fluid ejection system 102 incorporating a fluidic die 106 for thermal zone selection with a circular shift register 118 according to an example of the principles described herein. To achieve its desired functionality, the fluid ejection system 102 may include various hardware components. For example, among these hardware components may be a number of processors, a number of data storage devices, a number of peripheral device adapters, and a number of network adapters (not shown). These hardware components may be interconnected through the use of a number of busses and/or network connections.

In some examples, the fluid ejection system 102 may be a two-dimensional (2D) printer (e.g., thermal inkjet printer, piezoelectric inkjet printer, etc.) In other examples, the fluid ejection system 102 may be a three-dimensional (3D) printer. In other examples, the fluid ejection system 102 may correspond to pharmaceutical dispensation devices, lab-on-a-chip devices, fluidic diagnostic circuits, and/or other such devices in which small volumes (e.g., microliters, picoliters, etc.) of fluid may be conveyed, analyzed, and/or dispensed.

The fluid ejection system 102 also includes a number of fluid ejection devices 104. Although one fluid ejection device 104 is depicted in the example of FIG. 1, any number of fluid ejection devices 104 may exist within the fluid ejection system 102. The fluid ejection devices 104 may be fixed or scanning fluid ejection devices. The fluid ejection devices 104 may be coupled to the processor of the fluid ejection system 102 via a bus. The fluid ejection devices 104 may receive print data in the form of a print job. For example, the print data may be consumed by the fluid ejection devices 104 and used to produce a physical print representing the print job.

Each fluid ejection device 104 includes a number of fluidic dies 106. Although one fluidic die 106 is depicted in the example of FIG. 1, any number of fluidic dies 106 may exist within the fluid ejection device 104. A fluidic die 106 may include multiple thermals zones 108. An example of a fluidic die is described in connection with FIG. 3.

Each thermal zone 108 may include a number of fluidic actuators 110 (also referred to as a primitive). The thermal zones may include a single fluidic actuator 110 or multiple fluidic actuators 110.

In some examples, the fluidic actuator 110 may be an ejecting actuator. An ejecting actuator may correspond to a fluidic actuator 110 disposed in an ejection chamber, where the ejection chamber may be fluidically coupled to a nozzle. Accordingly, by electrically actuating an ejection actuator, a drop of fluid may be ejected via the nozzle fluidically coupled to the ejection chamber. For instance, a fluid (e.g., ink) may flow through the fluidic die 106 to a fluidic actuator 110. In some examples, the fluidic actuator 110 may deposit the fluid on a print medium. In other examples, the fluidic actuator 110 may eject the fluid without a print medium.

In some examples, the fluidic actuator 110 may use heat to cause the fluid to exit the fluidic actuator 110 (through a nozzle, for instance). For instance, the fluidic actuator 110 may generally refer to a resistor (e.g., thermal resistor or a piezoelectric resistor) disposed in an ejection chamber.

In other examples, the fluidic actuator 110 may be a non-ejecting actuator. For example, the fluidic actuator 110 may be a micro-pump that moves fluid on the fluidic die 106. In such examples, a fluidic actuator 110 in the form of a micro-pump may be disposed in a microfluidic channel. Accordingly, actuation of the fluidic actuator 110 in such examples may cause displacement of fluid in the microfluidic channel.

As used herein, a "fluid ejection device" and a "fluidic die" mean that part of a fluid ejection system 102 that dispenses fluid from one or more openings. A fluid ejection device includes a number of fluidic dies. "Fluid ejection device" and "fluidic die" are not limited to printing with ink and other printing fluids but may also include dispensing of other fluids and/or for uses other than printing.

A thermal zone 108 may include at least one temperature sensor 112. The temperature sensor 112 may measure the temperature of the thermal zone 108. For example, it may be beneficial to know the average temperature of the fluidic actuators 110 in a given thermal zone 108. In some examples, the fluidic actuators 110 in a given thermal zone 108 may receive the same pulse, and an average temperature of the fluidic actuators 110 (e.g., nozzles) in the thermal zone 108 may be determined. In some approaches, a thermal zone 108 may include multiple temperature sensors 112 from which an average temperature for the thermal zone 108 may be determined. In other approaches, the thermal zone 108 may include a single temperature sensor 112 at a specific point in the thermal zone 108, which may be used to represent the average temperature of the thermal zone 108.

A thermal zone 108 may also include an actuation pulse adjuster 114. The actuation pulse adjuster 114 may adjust an actuation pulse. As used herein, an actuation pulse may include a precursor pulse (PCP), a fire pulse or some other actuation pulse for the fluidic actuator 110. A PCP may occur before the main fire pulse in a thermal zone 108. The PCP may be adjusted by the actuation pulse adjuster 114 to compensate for the temperature variation to reduce having to adjust the temperature on the fluidic die 106 (e.g., by adding heat to or removing heat from the fluidic die 106). The actuation pulse adjuster 114 may receive an adjustment value for an adjusted actuation pulse from the shared thermal control circuitry 116.

The actuation pulse adjuster 114 may output an adjusted actuation pulse to drive heating of the thermal zone 108. In some examples, the actuation pulse adjuster 114 may adjust the PCP based on the adjustment value. In other examples, the actuation pulse adjuster 114 may adjust the main fire pulse based on the adjustment value. In yet other examples, the actuation pulse adjuster 114 may adjust the some other actuation pulse based on the adjustment value.

The fluidic die 106 may include shared thermal control circuitry 116 to process the multiple thermal zones 108. As used herein, processing a thermal zone 108 by the shared thermal control circuitry 116 may include receiving a temperature sensor output from a given thermal zone 108, determining an adjustment value for the actuation pulse based on the temperature sensor output and sending the adjustment value to the actuation pulse adjuster 114 of the given thermal zone 108. The shared thermal control circuitry 116 may be coupled to the multiple thermal zones 108.

The systems, apparatus and methods described herein provide for continually selecting thermal zones 108 in sequence so that the thermal zones 108 can be processed to control the temperature of those thermal zones 108. This thermal zone selection may be done in a fashion that ensures each thermal zone 108 is processed frequently enough to prevent thermal overshoot or undershoot.

The thermal zone selection process may be implemented by having each thermal zone 108 processed by the shared thermal control circuitry 116 in sequence. The thermal zone selection sequence may be repeated (rather than randomly selecting thermal zones 108, for instance). This means that the multiple thermal zones 108 are to be processed within the limited amount of time before a thermal zone's temperature moves further than desired.

The described systems, methods and apparatus provides for continuous sequential selection of thermal zones 108 to be processed by the shared thermal control circuitry 116. The thermal zone selection may be implemented by a circular shift register 118 (also referred to as a selection register). The circular shift register 118 may include multiple memory elements 120. Each memory element 120 may be associated with one thermal zone 108. For example, a first memory element 120 may be associated with a first thermal zone 108, a second memory element 120 may be associated with a second thermal zone 108 and so forth.

In some examples, the multiple memory elements 120 may be constructed of D-type flip flops. In this case, one D-type flip flop may be associated with one thermal zone 108. This results in a minimal amount of circuitry for per thermal zone 108, where a thermal zone 108 may span dozens of nozzles (multiple primitives). An example, of a circular shift register 118 using D-type flip flops is described in FIG. 2.

A token (e.g., a token bit or bits) may circulate within the circular shift register to select one thermal zone 108 at a time for processing by the shared thermal control circuitry 116. For example, the token may represent an active state for a given thermal zone 108. In other words, when a memory element 120 receives the token, the associated thermal zone 108 is selected to be in an active state. When the thermal zone 108 is in the active state, the thermal zone 108 may transmit a thermal state (e.g., temperature sensor output) to the shared thermal control circuitry 116. Additionally, when in an active state, the thermal zone 108 may receive thermal control results (e.g., an adjustment value for an adjusted actuation pulse) from the shared thermal control circuitry 116.

In some examples, the token may be a bit. For example, the token may be a logic "1". The single token bit may circulate within the circular shift register 118, selecting one thermal zone 108 at a time for processing.

The token may advance from one memory element 120 to another memory element 120 such that only one memory element 120 in the circular shift register 118 has the token at a time. In other words, only one memory element 120 may be in an active state at a time. Thus, the token may circulate within the circular shift register 118 to select one thermal zone 108 at a time for processing by the shared thermal control circuitry 116.

When a thermal zone 108 is selected by the circular shift register 118, the shared thermal control circuitry 116 may process the current (i.e., selected) thermal zone 108. As the token active state (e.g., logic "1") enters the memory element 120 of a thermal zone 108, the state of that memory element 120 enables transmission of the thermal zone's thermal state (e.g., temperature sensor output) to the shared thermal control circuitry 116, and enables transmission of thermal control results (e.g., actuation pulse adjustment value) back to the thermal zone 108.

The token may be advanced by a command from the shared thermal control circuitry 116 once processing of a current thermal zone 108 is complete. For example, once the shared thermal control circuitry 116 finishes processing the selected thermal zone 108, the shared thermal control circuitry 116 may cause a clock signal to be sent to the memory elements 120. When the active memory element 120 receives the clock signal, it enters an inactive state (e.g., logic "0") and the subsequent memory element 120 enters an active state (e.g., logic "1"). Therefore, the command from the shared thermal control circuitry 116 causes the token to advance from a current memory element 120 to a subsequent memory element 120.

The token may advance in the circular shift register 118 in a repeating sequence. For example, in some examples, the token may start at a first memory element 120 and may advance to subsequent memory elements 120. Upon reaching a last memory element 120, the token may advance back to the first memory element 120 and the cycle may be repeated.

In some examples, for better spatial distribution of thermal zone selection during a full cycle, the token in the circular shift register 118 can be advanced each time by an amount other than "1" memory element 120. For example, with an 8-thermal zone column, the token could be advanced by 3 memory elements 120 for each processing instance by the shared thermal control circuitry 116. In this case, the thermal zones 108 would be processed as: 0, 3, 6, 1, 4, 7, 2, 5, 0, 3, 6 and so forth. The sequence used for thermal zone selection may be optimized based on the thermal zone spatial distribution.

In some examples, an arbitrarily designated thermal zone 108 may be selected for processing by the shared thermal control circuitry 116. For example, a specific number of clock pulses may be issued to the circular shift register 118 to cause a certain thermal zone 108 to be selected for processing.

In some examples, the circular shift register 118 may be initialized once at fluidic die startup. Upon initialization, a selected memory element 120 may be preset with the token. Thus, the thermal zone 108 associated with the selected memory element 120 may be in an active state upon initialization.

For safety purposes, in some examples, the fluidic die 106 may include a monitor circuit 122. The monitor circuit 122 (also referred to as a watchdog circuit) may periodically reinitialize the circular shift register 118. For example, the monitor circuit 122 may provide a signal that periodically resets all the memory elements 120 to zero, and then sets one memory element 120 to an active state. The monitor circuit 122 may address cases where multiple memory elements 120 get set to an active state (due to noise, for instance), which may produce compromised thermal sense data. The monitor circuit 122 may also address cases where the state of the single active memory element 120 is corrupted to become inactive (which would make it so no thermal zone control would take place. Either of these cases would cause some type of fluid ejection device malfunction. Having a monitor circuit 122 periodically reset the circular shift register 118 may resolve these issues.

In some examples, the monitor circuit 122 may be implemented as a timer. For example, the monitor circuit 122 may issue an initialization signal to the circular shift register 118 after a certain amount of time. In other examples, the monitor circuit 122 may be implemented as a counter. When the monitor circuit 122 reaches a maximum count, the monitor circuit 122 may issue an initialization signal to the circular shift register 118.

The thermal zone selection described herein provides for repeating, sequential selection of all thermal zones 108 for thermal processing with minimal circuitry per zone. Furthermore, the thermal zone selection may operate autonomously (e.g., without thermal zone addressing that originates outside the fluidic die). By using a monitor circuit 122, the fluidic die 106 may self-correct from corruption of the token data in the circular shift register 118.

Performing thermal zone selection on the fluidic die 106 provides additional benefits. For example, locating the shared thermal control circuitry 116 on the same fluidic die 106 as the thermal zones 108 may reduce errors caused by an electrically noisy environment. The number of interconnections between the fluidic die 106 and other components outside the fluidic die 106 may also be reduced, which reduces the complexity, cost and size due to the number of pads used for interconnections. Also, the sensing bandwidth of the temperature sensors 112 may be increased.

Figure 2:
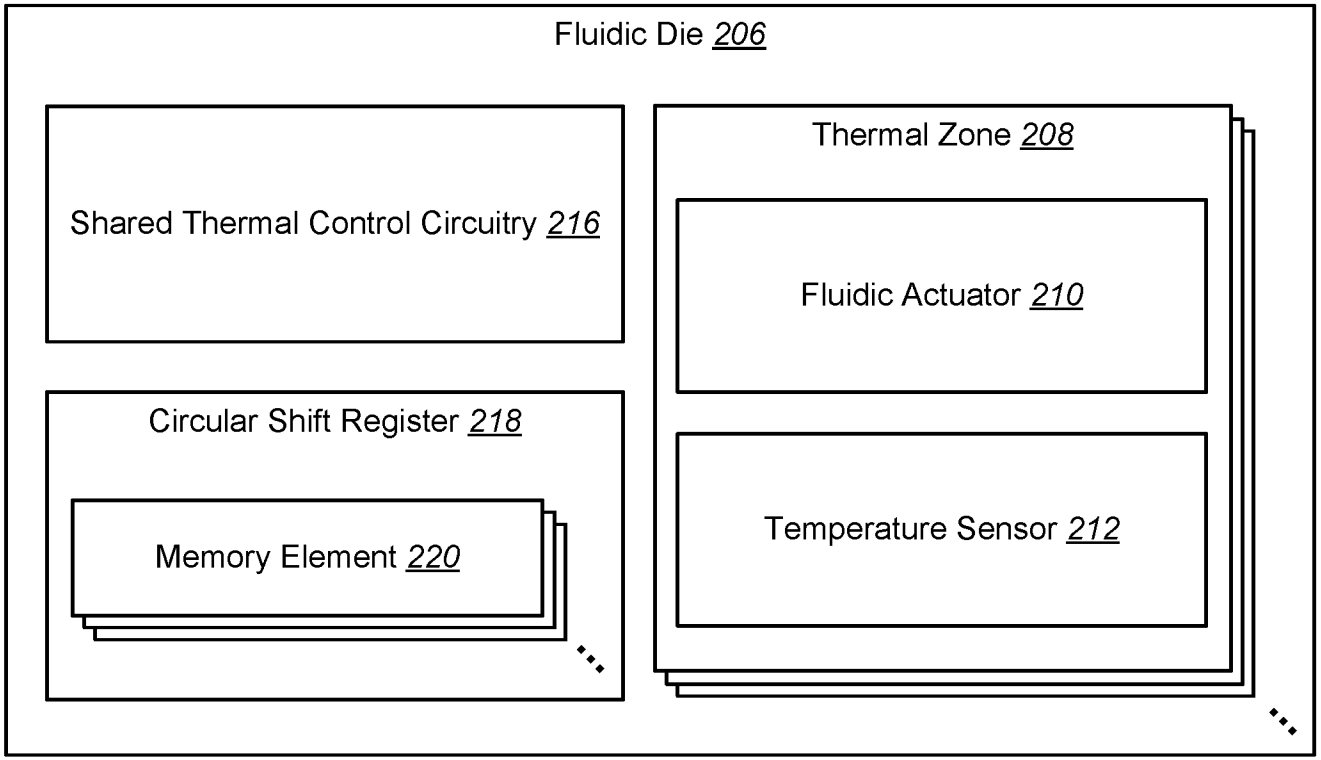
FIG. 2 is a block diagram illustrating an example of a fluidic die.

FIG. 2 is a block diagram illustrating an example of a fluidic die 206. The fluidic die 206 may be implemented in accordance with the fluidic die 106 described in connection with FIG. 1.

The fluidic die 206 may include multiple thermal zones 208. Each thermal zone 208 may include a temperature sensor 212 and a fluidic actuator 210. The fluidic die 206 may also include shared thermal control circuitry 216 to process an output of the temperature sensor 212 in a selected thermal zone 208.

The fluidic die 206 may further include a circular shift register 218 that includes multiple memory elements 220. Each memory element 220 may be associated with one thermal zone 208. In some examples, the multiple memory elements 220 may include D-type flip flops.

A token may circulate within the circular shift register 218 to select one thermal zone 208 at a time for processing by the shared thermal control circuitry 216. The token may be advanced by a command from the shared thermal control circuitry 216 once processing of the selected thermal zone 208 is complete. The command from the shared thermal control circuitry 216 may cause the token to advance from a current memory element 220 to a subsequent memory element 220. In some examples, the token may advance in the circular shift register 218 in a repeating sequence.

When the token advances to a memory element 220 of the selected thermal zone 208, the selected thermal zone 208 enters an active state to transmit a thermal state to the shared thermal control circuitry 216 and to receive thermal control results from the shared thermal control circuitry 216.

Figure 3:
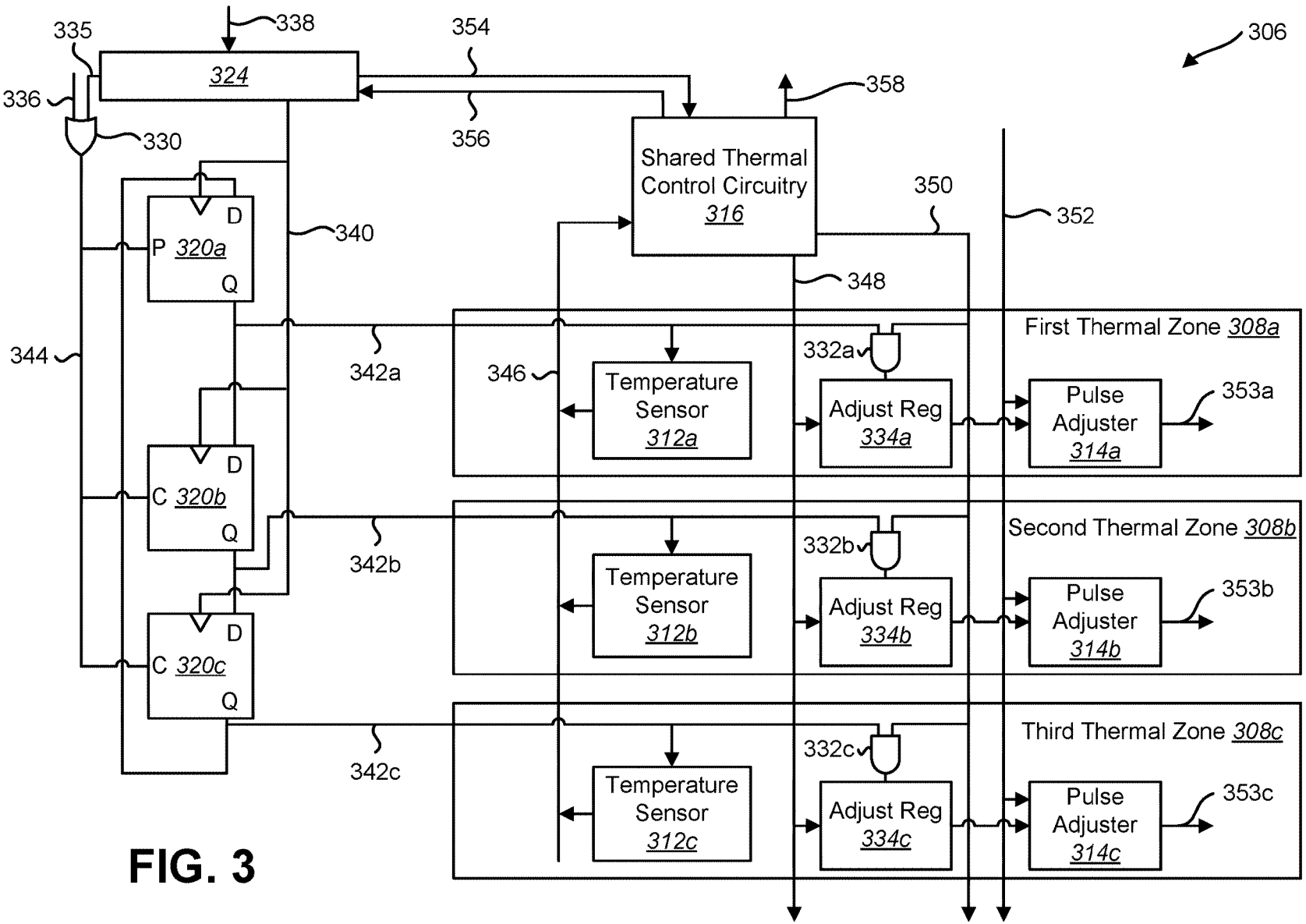
FIG. 3 is a block diagram illustrating an example of a fluidic die for thermal zone selection with a circular shift register.

FIG. 3 is a block diagram illustrating an example of a fluidic die 306 for thermal zone selection with a circular shift register. The fluidic die 306 may be implemented in accordance with the fluidic die 106 described in connection with FIG. 1 and the fluidic die 206 described in connection with FIG. 2.

The fluidic die 306 may include multiple thermal zones 308*a-c*. In this example, three thermal zones 308*a-c* are depicted. However, the fluidic die 306 may include at least two thermal zones 308. Each thermal zone 308 may include a temperature sensor 312, an adjustment register (adjust reg) 334 and an actuation pulse adjuster (pulse adjuster) 314.

The fluidic die 306 may also include a shared thermal control circuitry 316. The shared thermal control circuitry 316 may be coupled to the temperature sensors 312*a-c* and the adjustment registers 334*a-c*. In this example, the shared thermal control circuitry 316 may be coupled to the temperature sensors 312*a-c* via a temperature sensor bus on which the temperature sensors 312*a-c* may send their temperature sensor output 346.

The shared thermal control circuitry 316 may be coupled to the adjustment registers 334*a-c* via an adjust value bus over which the shared thermal control circuitry 316 may send an adjustment value signal 348 to the adjustment registers 334*a-c*. The adjustment value signal 348 may indicate an amount to adjust the fire pulse 352 by the actuation pulse adjuster 314.

An actuation pulse adjuster 314 may output an adjusted actuation pulse 353 (e.g., fire pulse or PCP) based on the adjustment value 348 received from the adjustment register 334. For example, when the actuation pulse adjuster 314 receives a fire pulse 352, then the actuation pulse adjuster 314 may trim or lengthen the fire pulse 352 according to the adjustment value 348 to produce the adjusted actuation pulse 353. In another example, the actuation pulse adjuster 314 may trim or lengthen the PCP according to the adjustment value 348 to produce the adjusted actuation pulse 353.

The shared thermal control circuitry 316 may also be coupled to the adjustment registers 334*a-c* via a register enable bus. The shared thermal control circuitry 316 may send a register enable signal 350 to the adjustment registers 334*a-c* via the register enable bus. The register enable signal 350 may enable an adjustment register 334 to store the adjustment value 348 provided by the shared thermal control circuitry 316. The register enable signal 350 may be "1" when active and "0" when inactive.

Each of the adjustment registers 334*a-c* may be coupled to an AND gate 332. One input of the AND gates 332*a-c* may be coupled to the register enable signal 350. Another input of the AND gates 332*a-c* may be coupled to a zone select signal 342. When both of the register enable signal 350 and the zone select signal 342 are "1" (e.g., logic "1") for a given adjustment register 334, then the given adjustment register 334 may store the adjustment value 348 and pass the adjustment value 348 to its respective actuation pulse adjuster 314. It should be noted that the same logical function of the AND gates 332 may be accomplished with other logical gates than the AND gates 332 described herein.

The zone select signal 342 of a thermal zone 308 may also be coupled to the temperature sensor 312 of that thermal zone 308. The temperature sensor 312 may output its temperature measurement when the zone select signal 342 is "1". Thus, the shared thermal control circuitry 316 may receive the temperature sensor output 346 of the selected thermal zone 308.

The fluidic die 306 may include a circular shift register to select a thermal zone 308 for processing by the shared thermal control circuitry 316. In this example, the circular shift register includes a number of flip flops 320*a-c*, which may be implemented in accordance with the memory elements 120 described in connection with FIG. 1. In some examples, the flip flops 320*a-c* may be D-type flip flops.

Each flip flop 320 may be associated with a given thermal zone 308. For example, the output (Q) of a first flip flop 320*a* may be coupled to the AND gate 332*a* of the first thermal zone 308*a*. The output (Q) of a second flip flop 320*b* may be coupled to the AND gate 332*b* of the second thermal zone 308*b*. The output (Q) of a third flip flop 320*c* may be coupled to the AND gate 332*c* of the third thermal zone 308*c*. It should be noted that in other examples, other gates besides AND gates may be used to implement the function of the AND gates 332 described herein.

The flip flops 320*a-c* may be coupled to form a circular shift register. For example, the output (Q) of the first flip flop 320*a* may be coupled to the input (D) of the second flip flop 320*b*. The output (Q) of the second flip flop 320*b* may be coupled to the input (D) of the third flip flop 320*c*. To complete the chain, the output (Q) of the last flip flow (i.e., the third flip flop 320*c*) may be coupled to the input (D) of the first flip flop 320*a*.

The output (Q) of the flip flops 320*a-c* may be a zone select signal 342. For example, the output (Q) of the first flip flop 320*a* may be the zone select signal 342*a* of the first thermal zone 308*a*. The output (Q) of the second flip flop 320*b* may be the zone select signal 342*b* of the second thermal zone 308*b*. The output (Q) of the third flip flop 320*c* may be the zone select signal 342*c* of the third thermal zone 308*c*.

The flip flops 320*a-c* may store an input (D) value upon receiving a clock signal 340 at a clock port (V). The flip flops 320*a-c* then output the stored value.

The fluidic die 306 may include a circular shift register controller 324. The circular shift register controller 324 may provide a clock signal 340 to the flip flops 320*a-c*. In this example, the flip flops 320*a-c* may be initialized by an initialization signal 344. In some examples, an initialization signal 336 may be received at an OR gate 330, which passes the initialization signal 344 to the flip flops 320*a-c*.

It should be noted that the first flip flop 320*a*, includes a preset port (P) and the other flip flops 320*b-c* include a clear port (C). Upon receiving the initialization signal 344, the preset port (P) causes the first flip flop 320*a* to store a "1" value and the clear ports (C) cause the other flip flops 320*b-c* to store a "0" value. Thus upon initialization, the first flip flop 320*a* stores the token bit.

The flip flops 320*a-c* may pass a token from one flip flop 320 to another to select one thermal zone 308 at a time for processing by the shared thermal control circuitry 316. For example, upon initialization, the output of the first flip flop 320*a* is "1", which causes the zone select signal 342*a* of the first thermal zone 308*a* to be "1." In this case, the temperature sensor 312*a* of the first thermal zone 308*a* may transmit its temperature sensor output 346 to the shared thermal control circuitry 316 for processing. Also, upon receiving the "1" on the zone select signal 342*a*, the adjustment register 334*a* of the first thermal zone 308*a* may store the adjustment value 348 sent by the shared thermal control circuitry 316.

The circular shift register controller 324 may send a clock signal 340 to advance the token to another flip flop 320. For example, if the first flip flop 320*a* has the token (e.g., outputs "1"), then upon receiving the clock signal 340, the output of the first flip flop 320*a* becomes "0" and the output of the second flip flop 320*b* becomes "1," thus selecting the second thermal zone 308*b* for processing by the shared thermal control circuitry 316.

In some examples, the circular shift register controller 324 may send a start processing command 354 to the shared thermal control circuitry 316 after advancing the token from one flip flop 320 to another flip flop 320. Upon receiving the start processing command 354, the shared thermal control circuitry 316 may process the thermal data.

Upon completing the thermal data processing, the shared thermal control circuitry 316 may send a processing complete command 356 to the circular shift register controller 324. This processing complete command 356 may cause the circular shift register controller 324 to advance the token to select another thermal zone 308 for processing. In other words, upon receiving the processing complete command 356, the circular shift register controller 324 may issue a number of clock signals 340 based on the thermal zone selection sequence.

As described above, the thermal zone selection sequence may be an amount other than one flip flop 320. For example, the circular shift register controller 324 may issue three clock signals 340 to advance the token by three flip flops 320.

In other examples, the circular shift register controller 324 may issue a specific number of clock signals 340 to select an arbitrarily designated thermal zone 308 for processing. For example, the print system (e.g., fluid ejection system 102) may issue a designated zone processing command 338 to perform processing on the third thermal zone 308*c*. The circular shift register controller 324 may initialize the flip flops 320*a-c* in the circular shift register. For example, the circular shift register controller 324 may send an initialization signal 335 to the OR gate 330, which passes the initialization signal 344 to the flip flops 320*a-c*. This initialization signal 335 may cause the first flip flop 320*a* to be active. The circular shift register controller 324 may then issue two clock signals 340 so that the third thermal zone 308*c* is selected.

The circular shift register controller 324 may issue a start processing command 354 to initiate the thermal data processing by the shared thermal control circuitry 316. Once the processing is complete, an analog to digital (A/D) processing result 358 may be read out to the print system.

Figure 4:
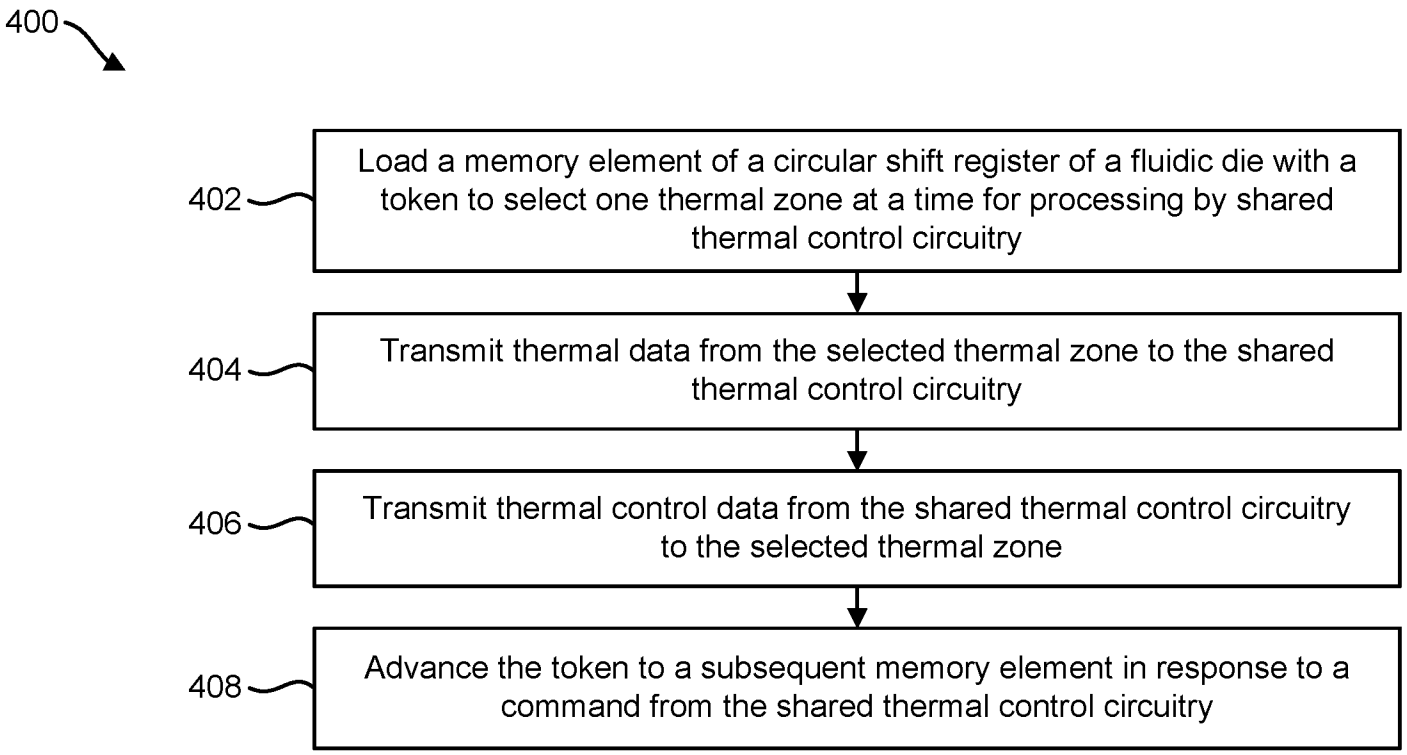
FIG. 4 is a flow diagram illustrating a method for thermal zone selection with a circular shift register.

FIG. 4 is a flow diagram illustrating a method 400 for thermal zone selection with a circular shift register 118. The method 400 may be implemented by a fluidic die 106 that includes multiple thermal zones 108, shared thermal control circuitry 116, and a circular shift register 118. Each thermal zone 108 may include a temperature sensor 112 and a fluidic actuator 110. The circular shift register 118 may include multiple memory elements 120. Each memory element 120 may be associated with one of the multiple thermal zones 108.

A memory element 120 of the circular shift register 118 may be loaded 402 with a token to select one thermal zone 108 at a time for processing by the shared thermal control circuitry 116. For example, a first memory element 120 may be initialized with a token bit set to "1" (e.g., logic "1") representing an active state. The other memory elements 120 in the circular shift register 118 may be initialized to "0" (e.g., logic "0") representing an inactive state.

The temperature sensor 112 of the selected thermal zone 108 may transmit 404 thermal data to the shared thermal control circuitry 116. For example, the thermal zone 108 associated with the memory element 120 that has the token may be in an active state. The shared thermal control circuitry 116 may receive the temperature sensor data from the selected thermal zone 108.

The shared thermal control circuitry 116 may transmit 406 thermal control data to the selected thermal zone 108. For example, the shared thermal control circuitry 116 may send an actuation pulse adjustment value to a actuation pulse adjuster 114 of the selected thermal zone 108. The actuation pulse adjuster 114 may then adjust the actuation pulse based on the adjustment value. The actuation pulse may be provided to the fluidic actuator 110 of the selected thermal zone 108.

The token may be advanced 408 to a subsequent memory element 120 in response to a command from the shared thermal control circuitry 116. For example, the token may be advanced 408 by a command from the shared thermal control circuitry 116 once processing of the selected thermal zone 108 is complete. The command from the shared thermal control circuitry 116 causes the token to advance 408 from a current memory element 120 to a subsequent memory element 120. When the token advances to a memory element 120 of a given thermal zone 108, the given thermal zone 108 enters an active state to transmit a thermal state to the shared thermal control circuitry 116 and to receive thermal control results from the shared thermal control circuitry 116.

Figure 5:
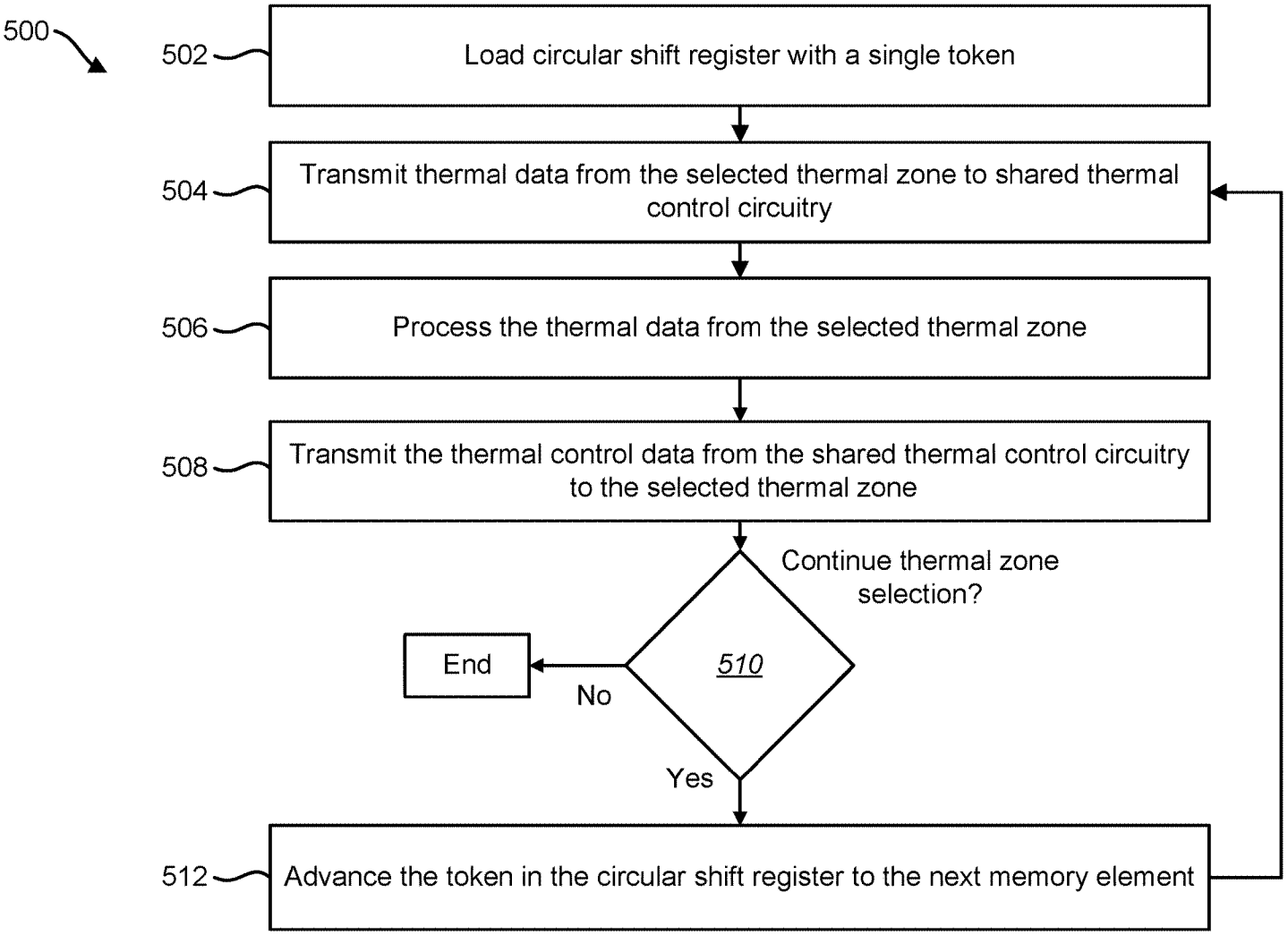
FIG. 5 is a flow diagram illustrating another method for thermal zone selection with a circular shift register.

FIG. 5 is a flow diagram illustrating another method 500 for thermal zone selection with a circular shift register 118. The method 500 may be implemented by a fluidic die 106 that includes multiple thermal zones 108, a shared thermal control circuitry 116 and a circular shift register 118.

The circular shift register 118 may be loaded 502 with a single token. For example, a first memory element 120 may be initialized with a token bit set to "1" (e.g., logic "1") representing an active state. The other memory elements 120 in the circular shift register 118 may be initialized to "0" (e.g., logic "0") representing an inactive state.

Thermal data (e.g., temperature sensor output) may be transmitted 504 from the selected thermal zone 108 to the shared thermal control circuitry 116. For example, the thermal zone 108 associated with the memory element 120 that has the token may be in an active state. The shared thermal control circuitry 116 may receive the temperature sensor data from the selected thermal zone 108.

Thermal data from the selected thermal zone 108 may be processed 506. For example, the shared thermal control circuitry 116 may determine an adjustment value for the actuation pulse of the selected thermal zone 108 based on the temperature sensor output.

Thermal control data may be transmitted 508 from the shared thermal control circuitry 116 to the selected thermal zone 108. For example, the shared thermal control circuitry 116 may send the actuation pulse adjustment value to the actuation pulse adjuster 114 of the selected thermal zone 108. The actuation pulse adjuster 114 may then adjust the actuation pulse based on the adjustment value.

The fluidic die 106 may determine 510 whether to continue thermal zone selection. If the thermal zone selection continues, then the token in the circular shift register 118 may be advanced 512 to the next memory element 120. For example, a number of clock pulses may be issued to the circular shift register 118 to cause a certain thermal zone 108 to be selected for processing. The selected thermal zone 108 may then enter an active state and may transmit 504 its thermal data to the shared thermal control circuitry 116.

Figure 6:
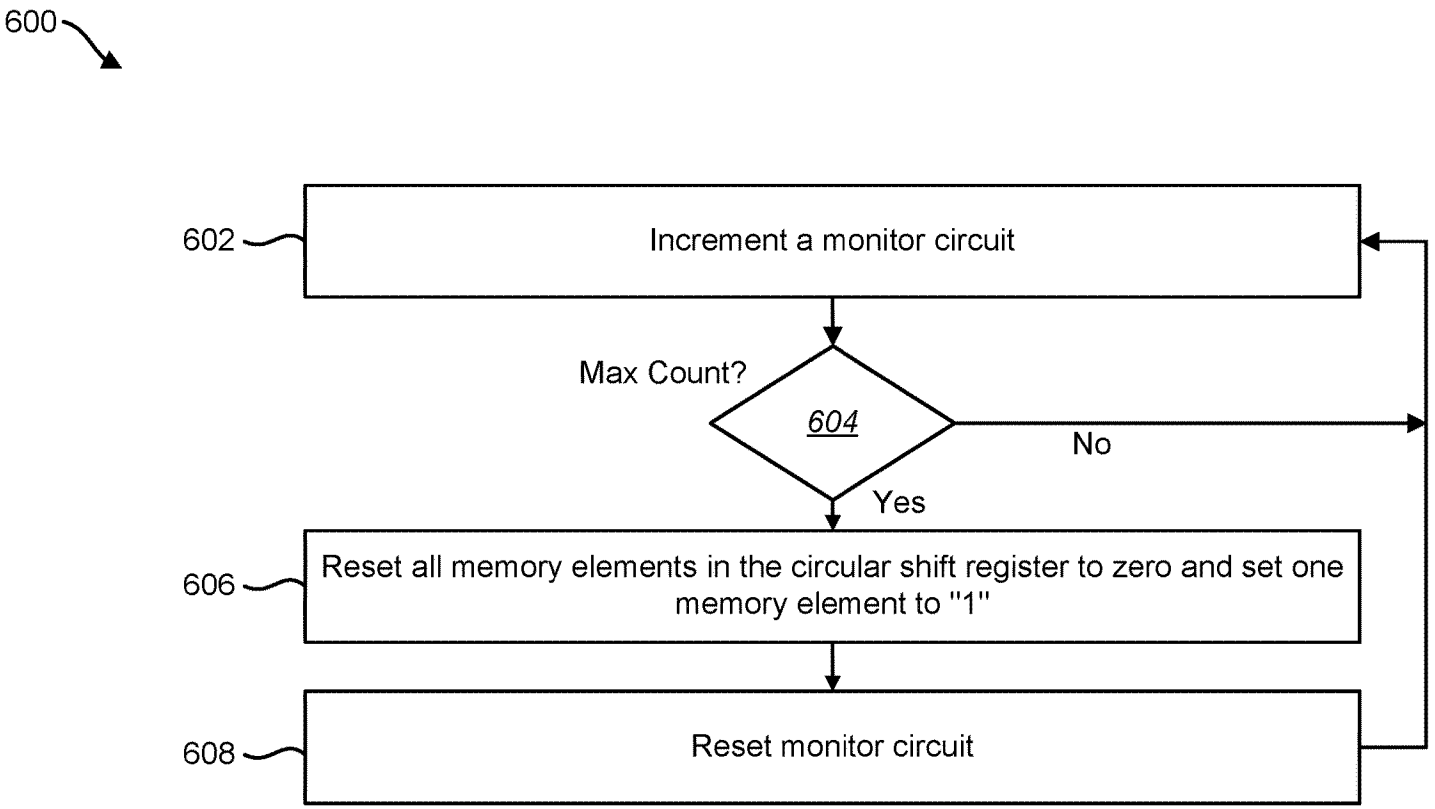
FIG. 6 is a flow diagram illustrating a method for reinitializing thermal zone selection with a circular shift register.

FIG. 6 is a flow diagram illustrating a method 600 for reinitializing thermal zone selection with a circular shift register 118. The method 600 may be implemented by a fluidic die 106 that includes multiple thermal zones 108, a shared thermal control circuitry 116, a circular shift register 118 and a monitor circuit 122.

The monitor circuit 122 may be incremented 602. For example, the monitor circuit 122 may be implemented as a counter. The count of the monitor circuit 122 may be increased by an amount (e.g., 1). In some examples, the monitor circuit 122 may be incremented 602 based on a clock signal. In other examples, the monitor circuit 122 may be incremented 602 after a certain amount of time.

The fluidic die 106 may determine 604 whether the count of the monitor circuit 122 has reached a maximum (max) count. For example, the maximum count may be a preconfigured value. If the count of the monitor circuit 122 has not reached a maximum count, then the monitor circuit 122 may be incremented 602.

If the count of the monitor circuit 122 has reached a maximum count, then the fluidic die 106 may reset 606 all memory elements 120 in the circular shift register 118 to zero and may set one memory element 120 to "1".

The monitor circuit 122 may be reset 608. For example, count of the monitor circuit 122 may be reset to zero. In some examples, this may be done automatically. The monitor circuit 122 may then be incremented 602 again.

The invention claimed is:

1. A fluidic die, comprising:

multiple thermal zones, wherein each thermal zone comprises a temperature sensor and a fluidic actuator;

shared thermal control circuitry to process an output of the temperature sensor in a selected thermal zone; and a circular shift register comprising multiple memory elements, each memory element being associated with one thermal zone, wherein a token circulates within the circular shift register to select one thermal zone at a time for processing by the shared thermal control circuitry.

2. The fluidic die of claim 1, wherein the token is advanced by a command from the shared thermal control circuitry once processing of the selected thermal zone is complete.

3. The fluidic die of claim 2, wherein the command from the shared thermal control circuitry causes the token to advance from a current memory element to a subsequent memory element.

4. The fluidic die of claim 1, wherein the multiple memory elements comprise D-type flip flops.

5. The fluidic die of claim 1, wherein when the token advances to a memory element of the selected thermal zone, the selected thermal zone enters an active state to transmit a thermal state to the shared thermal control circuitry and to receive thermal control results from the shared thermal control circuitry.

6. The fluidic die of claim 1, wherein the token advances in the circular shift register in a repeating sequence.

7. The fluidic die of claim 1, comprising a monitor circuit to periodically reinitialize the circular shift register.

8. The fluidic die of claim 1, wherein each thermal zone comprises an actuation pulse adjuster to receive an adjustment value for an adjusted actuation pulse when selected by the circular shift register for processing by the shared thermal control circuitry.

9. The fluidic die of claim 1, comprising an ejection chamber fluidly coupled to a nozzle, wherein the fluidic actuator is disposed in the ejection chamber.

10. A fluid ejection device, comprising:

a fluidic die, wherein the fluidic die comprises:

multiple thermal zones, wherein each thermal zone comprises a temperature sensor and a fluidic actuator;

shared thermal control circuitry to process an output of the temperature sensor in a selected thermal zone; and a circular shift register comprising multiple memory elements, each memory element being associated with one thermal zone, wherein a token circulates within the circular shift register to select one thermal zone at a time for processing by the shared thermal control circuitry.

11. The fluid ejection device of claim 10, wherein the token is advanced by a command from the shared thermal control circuitry once processing of the selected thermal zone is complete.

12. The fluid ejection device of claim 11, wherein the command from the shared thermal control circuitry causes the token to advance from a current memory element to a subsequent memory element.

13. The fluid ejection device of claim 10, wherein when the token advances to a memory element of the selected thermal zone, the selected thermal zone enters an active state to transmit a thermal state to the shared thermal control circuitry and to receive thermal control results from the shared thermal control circuitry.

14. A method by a fluidic die, comprising:

loading a memory element of a circular shift register of the fluidic die with a token, wherein the circular shift register comprises multiple memory elements, each memory element being associated with one of multiple thermal zones of the fluidic die, wherein each thermal zone comprises a temperature sensor and a fluidic actuator, and wherein the token circulates within the circular shift register to select one thermal zone at a time for processing by a shared thermal control circuitry of the fluidic die;

transmitting thermal data from the selected thermal zone to the shared thermal control circuitry;

transmitting thermal control data from the shared thermal control circuitry to the selected thermal zone; and advancing the token to a subsequent memory element in response to a command from the shared thermal control circuitry.

15. The method of claim 14, wherein when the token advances to a memory element of a given thermal zone, the given thermal zone enters an active state to transmit the thermal data to the shared thermal control circuitry and to receive the thermal control data from the shared thermal control circuitry.

* * * * *